US005219381A

United States Patent [19]

Jacecko, Jr. et al.

[11] Patent Number: 5,219,381

[45] Date of Patent: Jun. 15, 1993

[54] ATTACHABLE POWER-ASSISTED COPY INDICATOR

[76] Inventors: John M. Jacecko, Jr., 607 Poppy Ave., Corona Del Mar, Calif. 92625; Daniel J. Bruckner, 428 6th St., Manhattan Beach, Calif. 90266

[21] Appl. No.: 705,021

[22] Filed: May 22, 1991

[51] Int. Cl.[5] ..... B41J 11/64

[52] U.S. Cl. ..... 40/352; 40/343

[58] Field of Search ..... 40/352, 353, 356, 343; 400/718

[56] References Cited

U.S. PATENT DOCUMENTS

| | | | |
|---|---|---|---|
| 716,790 | 12/1902 | Towers et al. | 40/353 |
| 1,393,116 | 10/1921 | Guthridge | 40/356 |
| 1,881,103 | 10/1932 | Sperling . | |
| 3,332,399 | 7/1967 | Patrick et al. | 40/354 |
| 3,369,313 | 2/1968 | Vincent | 40/343 |
| 3,449,849 | 6/1969 | Di Pasquale et al. | 40/343 |
| 3,763,989 | 10/1973 | Goldman . | |
| 4,043,064 | 8/1977 | Friedman | 40/343 |
| 4,195,429 | 4/1980 | Wegner | 40/356 |
| 4,760,661 | 8/1988 | Yoshikoshi et al. | 40/352 X |

FOREIGN PATENT DOCUMENTS

| | | | |
|---|---|---|---|
| 24024 | 2/1922 | France | 40/356 |
| 859135 | 1/1961 | United Kingdom . | |

*Primary Examiner*—Kenneth J. Dorner
*Assistant Examiner*—J. Bonifanti

[57] ABSTRACT

A power-assisted copy indicator (20) that uses a mounting clamp assembly (38) to be attachable to a planar surface (24). Activating a driving means actuator one (52) causes an indicator (72) to move in one direction along its vertical axis, while activating a driving means actuator two (54) causes the same indicator (72) to move in the opposite direction along its vertical axis. An indicator clamp (76) allows one to attach and detach indicator (72), permitting selection of indicator (72) having a design appropriate for the intended application.

17 Claims, 10 Drawing Sheets

ATTACHABLE POWER-ASSISTED COPY INDICATOR

BACKGROUND

1. Field of Invention

This invention relates to copy indicators, specifically to a power-assisted copy indicator that can be attached to copyholders or similar planar surfaces.

2. Background of Invention

Individuals that need to visually scan copy often use a copyholder. The copy is placed on the holder so that it faces the user, allowing for more convenient viewing of the copy. If so equipped, a copy indicator is moved up and down the length of the copy to draw attention to an area of interest.

Originally, the copy indicator was a manual device. To utilize it, the user would have to physically take hold of the copy indicator and move it to the desired area of the copy. Repeating this motion every time a new portion of the copy was to be emphasized could cause fatigue and frustration for the user.

Thereafter, inventors created several copyholding devices with copy indicators that could be moved up and down the length of the copy with less effort. U.S. Pat. No. 716,790 to Towers et al. (1902) describes a purely mechanical copyholder with a copy indicator that is moved up and down by interaction with a type writing machine, or by a manual crank. This solely mechanical device gives rise to incompatibility with today's non-mechanical word processors, is not designed to be used with existing copyholding devices, and increases the risk of mechanical failure with its abundance of precise moving parts. U.S. Pat. No. 1,881,103 to Sterling (1932) describes a copyholding device with a copy indicator that can be moved down the length of the copy by either mechanically or electrically oriented means. Once again, the extensive parts list needed to build this device would increase the chance of mechanical breakdown and also raise production costs, and is not designed to be used with existing copyholding devices. U.S. Pat. No. 3,369,313 to Vincent (1968) and U.S. Pat. No. 3,449,949 to Di Pasquale et al. (1969) both describe copyholding devices that use roller type mechanisms to move a desired portion of copy to a fixed viewing area. These both employ rigid designs that would be costly to build, resulting in an expensive end product, and are not for use with existing copyholding devices. U.S. Pat. No. 3,763,989 to Goldman (1973) and U.S. Pat. No. 4,043,064 to Friedman (1977) describe copyholding devices with electronic "smart" copy indicators that use automatic line sensing and spacing mechanisms. The copy indicators of these copyholders move up and down the length of the copy as signaled by a variety of electrical, mechanical, optical, and acoustic sensing devices. In addition to not being designed for use with existing copyholding devices, the design complexity and resultant cost of the line sensing and spacing mechanisms employed by these inventions might outweigh their practicality.

In lieu of all the ideas set forth in the venture to build a better copyholder, a glance a today's market would reveal a need for fresh ideas. What one would find is a variety of simple copyholders and stands that serve only the purpose of holding copy to be scanned by the user. Many of them have copy indicators, but if so, they are invariably manual devices that are moved up and down the length of the copy by the user until left at rest at the area to be scanned. Accordingly, since a copyholder with or without a copy indicator is probably already owned by the user, or could be acquired quite economically, an entire copyholding and scanning device is not needed. Only a power-assisted copy indicator designed for easy attachment to the existing copyholder is necessary. If a user was to use one of the previously cited devices, the existing copyholding equipment would effectively be made useless, wasting resources and money. Thus, it becomes clear that the current devices heretofore known as solutions to the copy scanning problem are lacking as a result of the following key disadvantages:

(a) These devices were conceived to be stand alone units. They include in their designs the copyholder and the copy indicating mechanism as a single unit. They were not intended to be utilized in conjunction with existing basic copyholders, i.e. attached directly to a basic copyholder. This does not allow for users to merely upgrade their current copyholders or stands to have power-assisted copy indicators.

(b) Even though there have been many innovations regarding automatic line sensing and spacing mechanisms, a look at the currently available market shows little interest in the net utility of these ideas. The need for such a precise device has not been proven in the field.

(c) An elaborate line sensing and spacing mechanism will increase the device's production price and subsequent market price.

(d) The extensive number of parts and components required to build a copy indicator with automatic line sensing and spacing mechanisms increase its chances of breaking down, possibly requiring costly repairs.

OBJECTS AND ADVANTAGES

Accordingly, several objects and advantages of the present invention are:

(a) to provide an attachable power-assisted copy indicator that can be connected to a copy stand, copyholder, or similar planar surface;

(b) to provide an attachable power-assisted copy indicator that can use ergonomic alternatives to complex and expensive copy indicator line sensing and spacing mechanisms;

(c) to provide an attachable power-assisted copy indicator that is simple in design, flexible in its embodiment, and constructed with a minimum number of parts, many of which can be purchased "off-the-shelf"; and (d) to provide an attachable power-assisted copy indicator with a simple design that lessens the chance of mechanical and electronic failure and allows for inexpensive repair in that case.

A further object and advantage is to provide a attachable power-assisted copy indicator that can employ a copy indicator line sensing and spacing mechanism, if so desired. Still further objects and advantages of the invention will become apparent from a consideration of the ensuing description and drawings.

BRIEF DESCRIPTION OF THE DRAWINGS

In the drawings, closely related figures have the same number but different alphabetic suffixes.

DETAILED DESCRIPTION OF THE DRAWINGS

Figure 1:
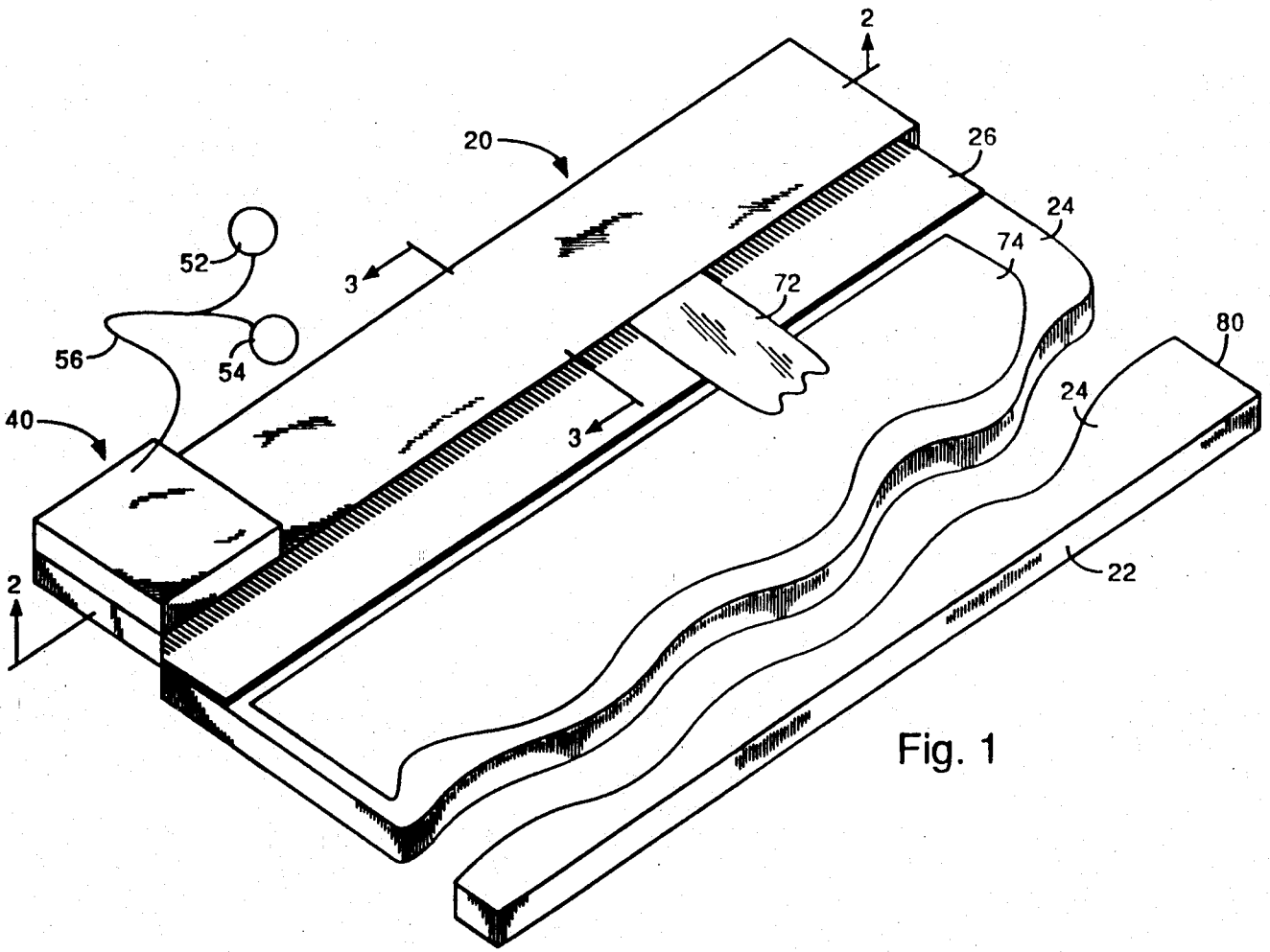
FIG. 1 shows a perspective view of a preferred embodiment of an attachable power-assisted copy indicator.
Figure 2:
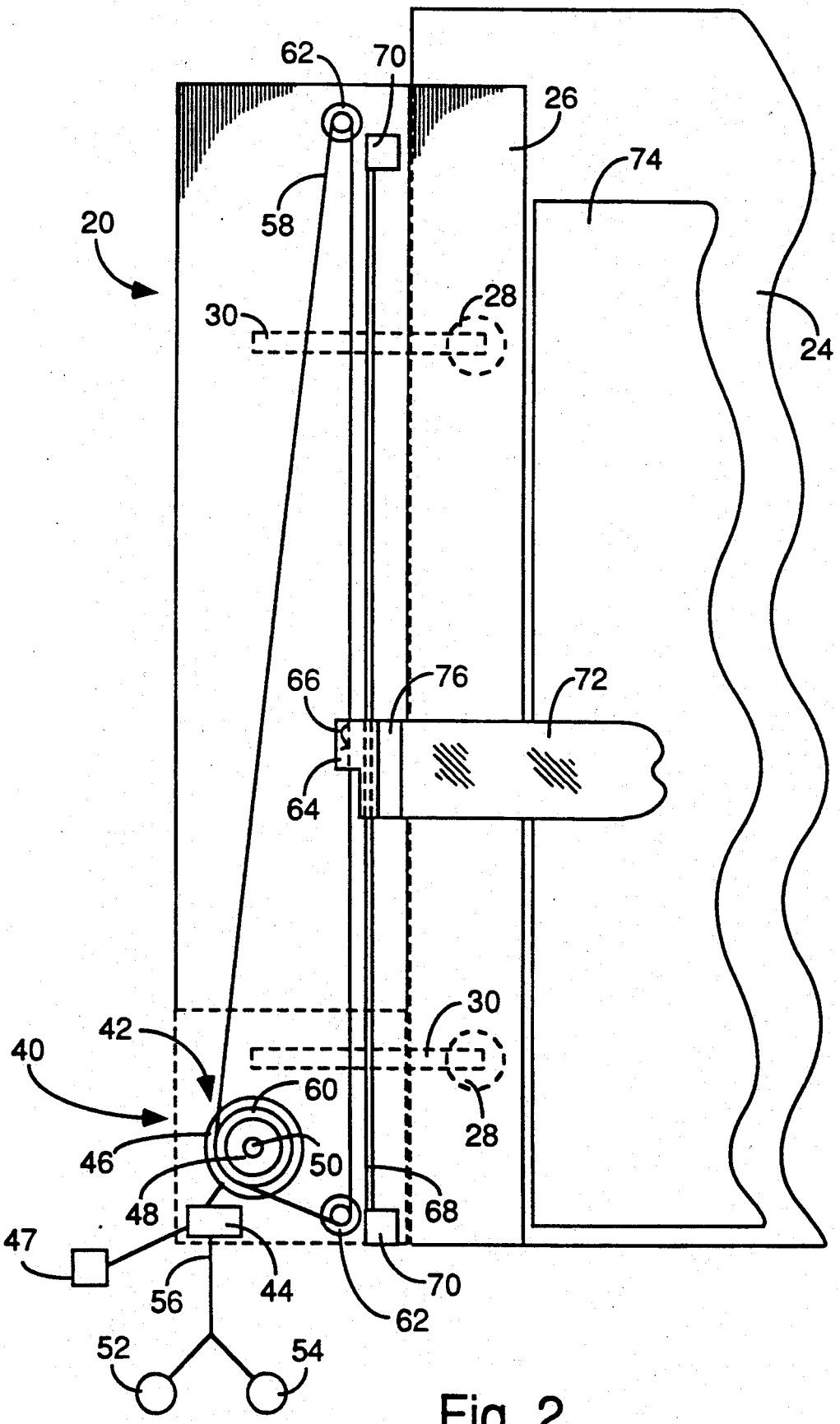
FIG. 2 is a cross sectional view taken along lines 2—2 in FIG. 1.
Figure 3A:
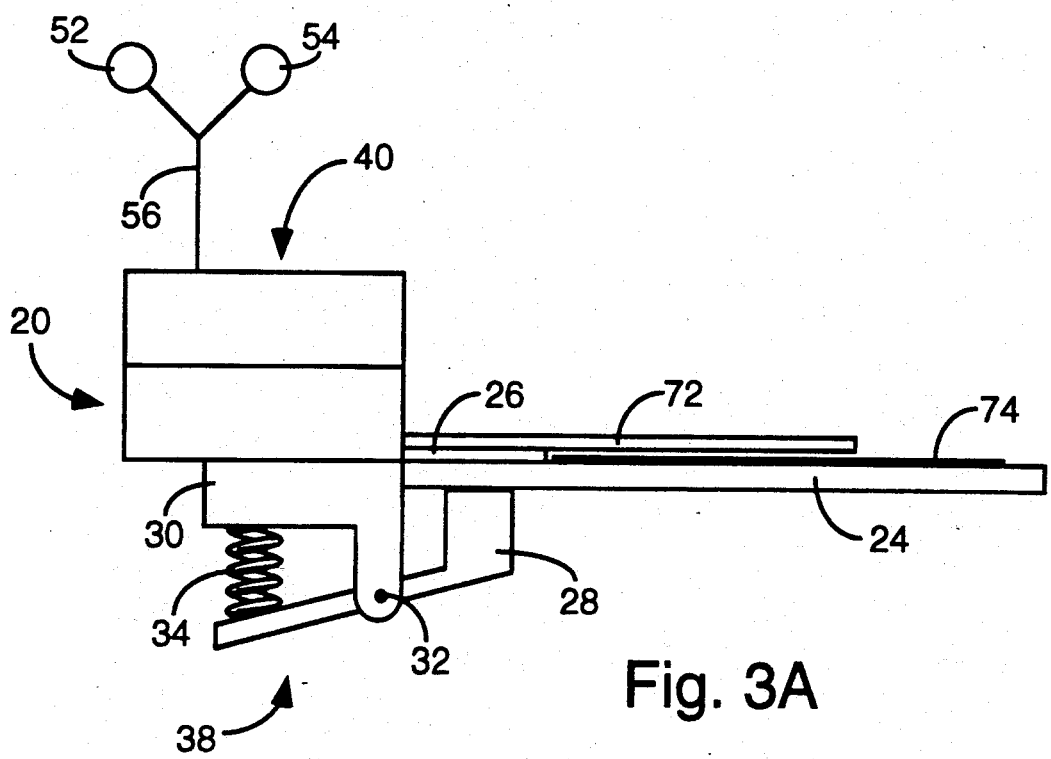
FIG. 3A is a cross sectional view taken along lines 3—3 in FIG. 1.
Figure 3B:
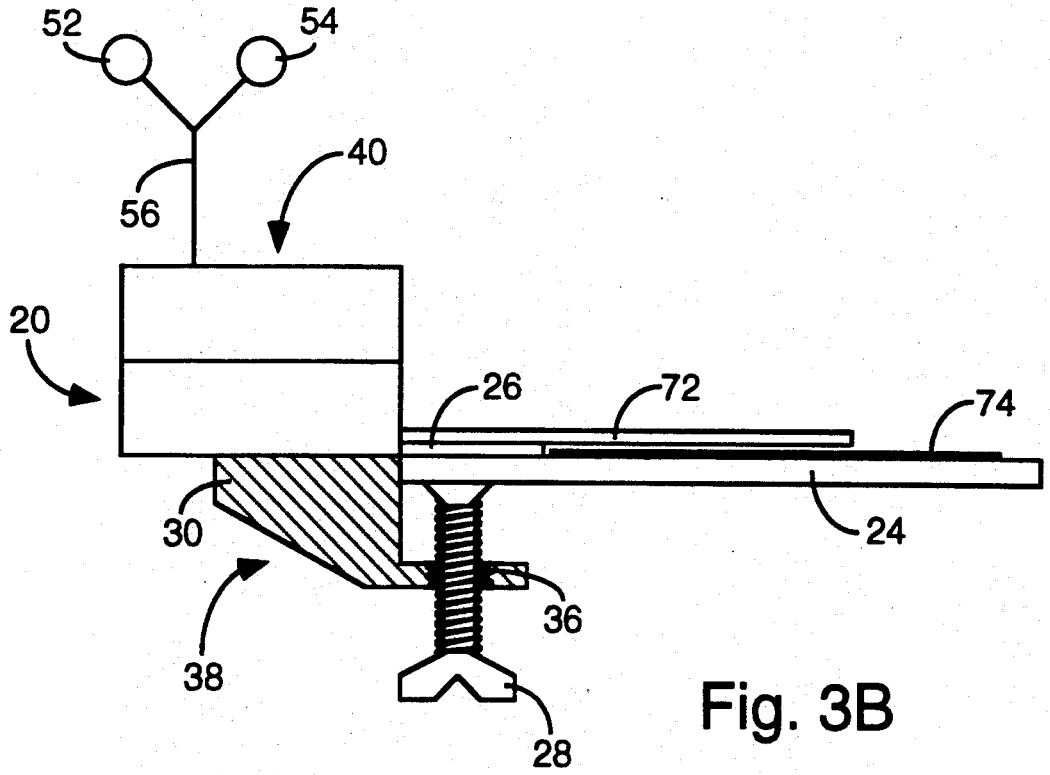
FIG. 3B is an alternate cross sectional view taken along lines 3—3 in FIG. 1.
Figure 10:
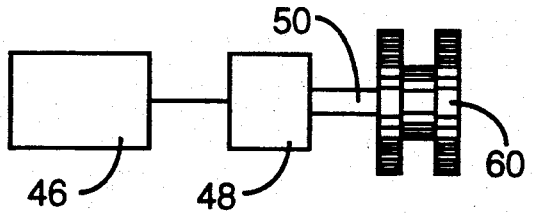
FIG. 10 is a block diagram of the drive motor and gear box assembly shown in FIG. 2.

A preferred embodiment of the attachable power-assisted copy indicator of the present invention is illustrated in FIG. 1 (perspective view), FIG. 2 (top view), FIG. 3A (side view), FIG. 3B (alternate side view), and FIG. 10 (block diagram). A side mounted attachable power-assisted copy indicator assembly 20 is attached securely to a side edge 22 of a planar surface 24, for example a copyholder, with a mounting lip 26 and a mounting clamp 28. In the embodiment shown in FIG. 3A, mounting clamp 28 is connected to a mounting clamp arm 30 by a pivot rod 32, with one end of a pressure spring 34 connected to mounting clamp arm 30 and the other end of pressure spring 34 connected to mounting clamp 28. In the embodiment shown in FIG. 3B, mounting clamp 28 can be a thumbscrew or threaded bolt, and is connected to mounting clamp arm 30 by a threaded screw guide 36. In both FIG. 3A and FIG. 3B, mounting clamp arm 30 is connected to copy indicator assembly 20 so that mounting clamp 28 opposes mounting lip 26. As needed, one or more of a mounting clamp assembly 38 will be connected to copy indicator assembly 20 to securely attach copy indicator assembly 20 to side edge 22 of planar surface 24.

As shown in FIG. 2, a side mounted attachable power-assisted copy indicator driving means assembly 40 includes a drive motor and gear box assembly 42, and a driving means controller 44. The location of driving means assembly 40 is not limited to that shown in FIG. 1, FIG. 2, FIG. 3A, and FIG. 3B. It can be placed anywhere about copy indicator assembly 20 in order to provide its function. It is shown where it is to suggest one possible location. Drive motor and gear box assembly 42 is comprised of a drive motor 46, a gear box 48, and a coupling 50, as shown in FIG. 10. Drive motor 46 can be chosen from many different types of motors. Some of the possibilities are synchronous, stepping, constant speed, and variable speed; these motors may be run from some type of AC or DC power source, 47, as their specifications mandate. Gear box 48 is only needed if the output of drive motor 46 requires stepping up or stepping down for actual use; if so, gear box 48 would be comprised of a gear ratio that when used with drive motor 46 would achieve an appropriate output rotation.

A driving means actuator one 52 and a driving means actuator two 54 are connected to driving means controller 44 via an actuator signal cables 56. Driving means actuator one 52 and driving means actuator two 54 can be embodied as keys attachable to a keyboard, floor pedals, push buttons, or any other type of actuating device that is convenient for the user to operate. Driving means controller 44 is to contain any intermediate electronics necessary for supplying power to the invention or transferring signals from driving means actuator one 52 and driving means actuator two 54 over to drive motor 46. Depending on the type of drive motor 46, driving means actuator one 52, and driving means actuator two 54 used, the design of driving means controller 44 may vary.

As shown in FIG. 2, connected to the output of drive motor 46, or if used to the output of gear box 48, both via coupling 50, is an indicator drive belt 58; indicator drive belt 58 can be connected to coupling 50 by a pulley 60 or similar device mounted on coupling 50. Indicator drive belt 58 can be an endless belt or a finite belt, and can be in the form of a flat belt, a notched or grooved belt, a wire, or a cord for example. What is important is that such a belt is chosen that offers an adequate amount of non-slippage between itself and pulley 60.

Indicator drive belt 58 is routed within copy indicator assembly 20 by one or more of a drive belt router 62, shown in FIG. 2. As friction would be involved when indicator drive belt 58 and drive belt router 62 rub against each other, reducing this friction would put less a strain on drive motor 46. To reduce this friction, drive belt router 62 should be in the form of a pulley or similar friction reducing device. One or more drive belt router 62 would be arranged so that a portion of indicator drive belt 58 would span as much of the vertical length of copy indicator assembly 20 as possible, shown in FIG. 2. Attached to indicator drive belt 58 at a point within the span just described is an indicator slide 64. It is attached most desirably by a leaf spring 66 or similar device that holds indicator slide 64 firmly to indicator drive belt 58, but also allows for manual displacement of indicator slide 64 to a different portion of the span of indicator drive belt 58 just described. This is shown in FIG. 2. Indicator slide 64 is designed to "slide" along a path dictated by an indicator movement guide 68. The designs of indicator slide 64 and indicator movement guide 68 thus depend on each other. If indicator movement guide 68 is a track of sorts, then indicator slide 64 must be designed to be seated in that track. If indicator movement guide 68 is to be a rod, then indicator slide 64 would have a bore in it through which the rod would pass. Other designs can be used accordingly to accomplish the same results. Indicator slide 64 may have to be designed to fit around drive belt router 62, as shown in FIG. 2. An indicator movement inhibitor 70 is placed at opposing ends of the span of indicator drive belt 58 described previously, so as to prevent indicator slide 64 from passing beyond the extreme ends of the span of indicator drive belt 58. Indicator movement inhibitor 70 is a physical block that could be molded as part of copy indicator assembly 20.

Attached to indicator slide 64 in an orientation perpendicular to the length of copy indicator assembly 20, is an indicator 72. Indicator 72 should extend out, over mounting lip 26 and a copy 74, both of which are on top of planar surface 24. Copy 74 is the material that is to be scanned by the user. Indicator slide 64 will provide a non-permanent indicator clamp 76, such as a holder or vice for example, that will securely hold indicator 72 in place.

As indicator clamp 76 is to be openable and closable, indicator 72 can be removed, replaced, or exchanged with a different indicator 72. Indicator 72 can be made from a variety of materials like plastic, metal, or wood for example. The design of indicator 72 can vary as the application for which it will be used dictates. For instance, indicator 72 can be made of transparent plastic with guide lines or sections of different color running horizontally across it, parallel with lines of text that it may be overlaying. It can be opaque, only allowing the user to use the top or bottom edge of indicator 72 as a point of reference. Once again, the design of indicator 72 is completely flexible so as to provide the best solution for its chosen application.

Figure 4:
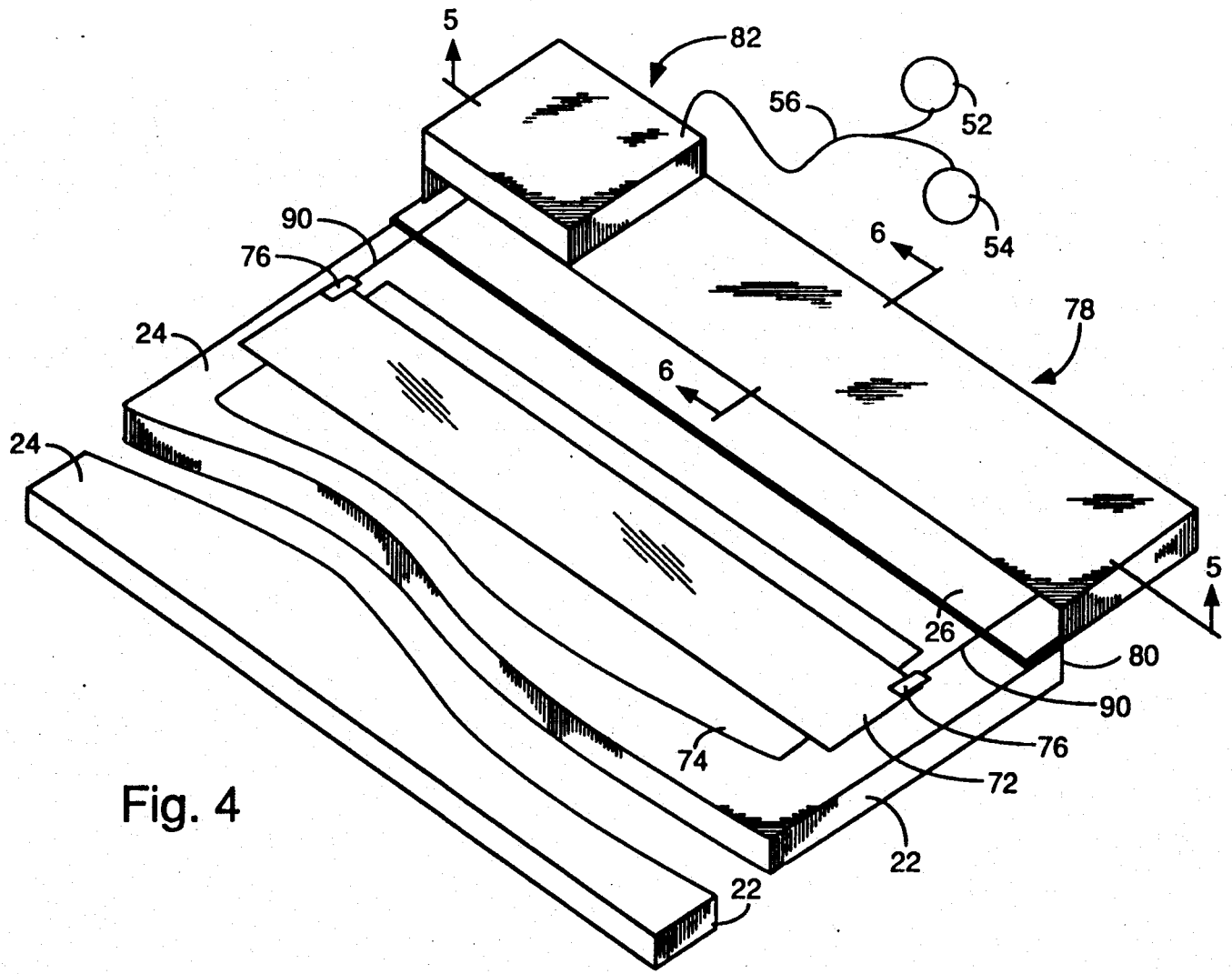
FIG. 4 shows a perspective view of an alternate embodiment of an attachable power-assisted copy indicator.
Figure 5:
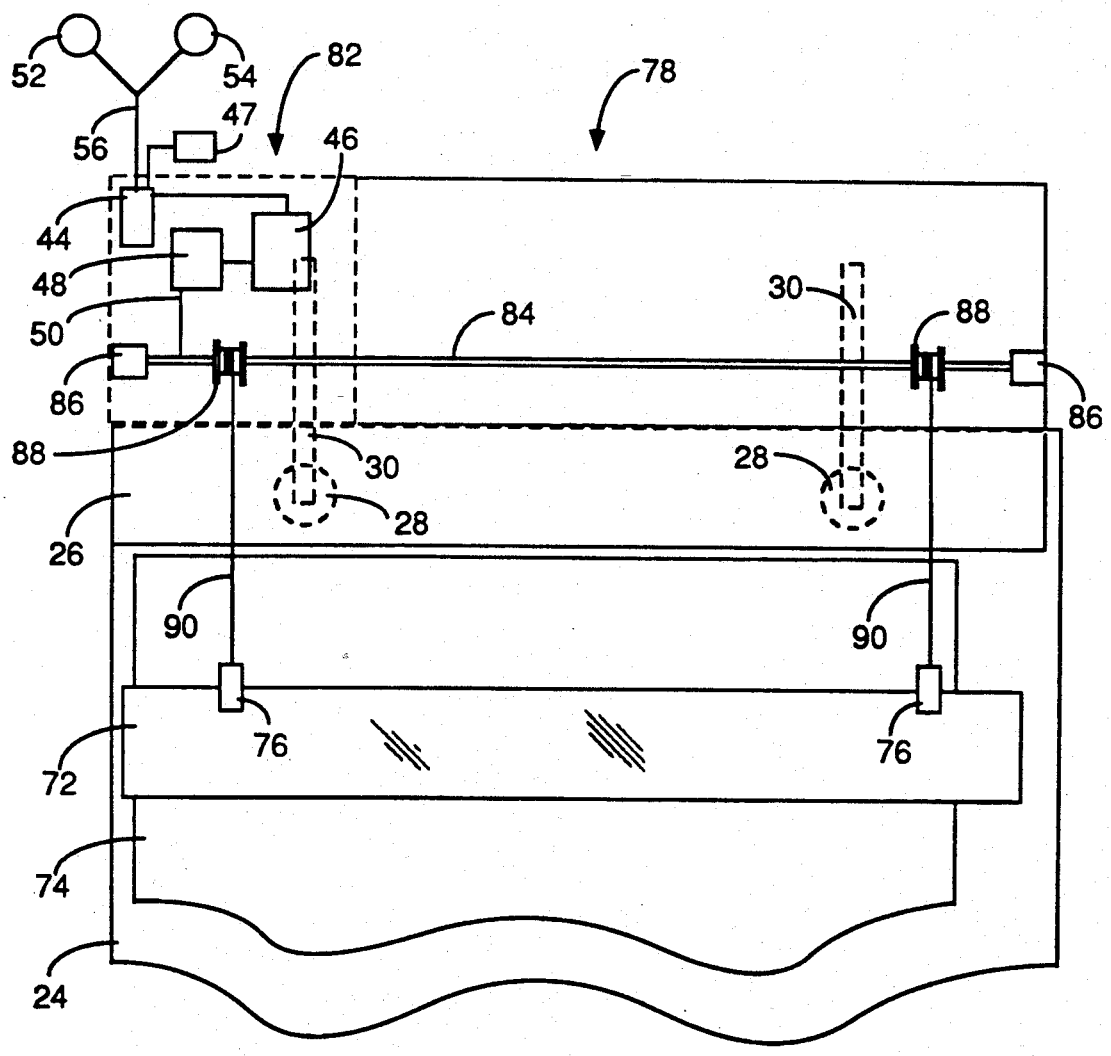
FIG. 5 is a cross sectional view taken along lines 5—5 in FIG. 4.
Figure 6A:
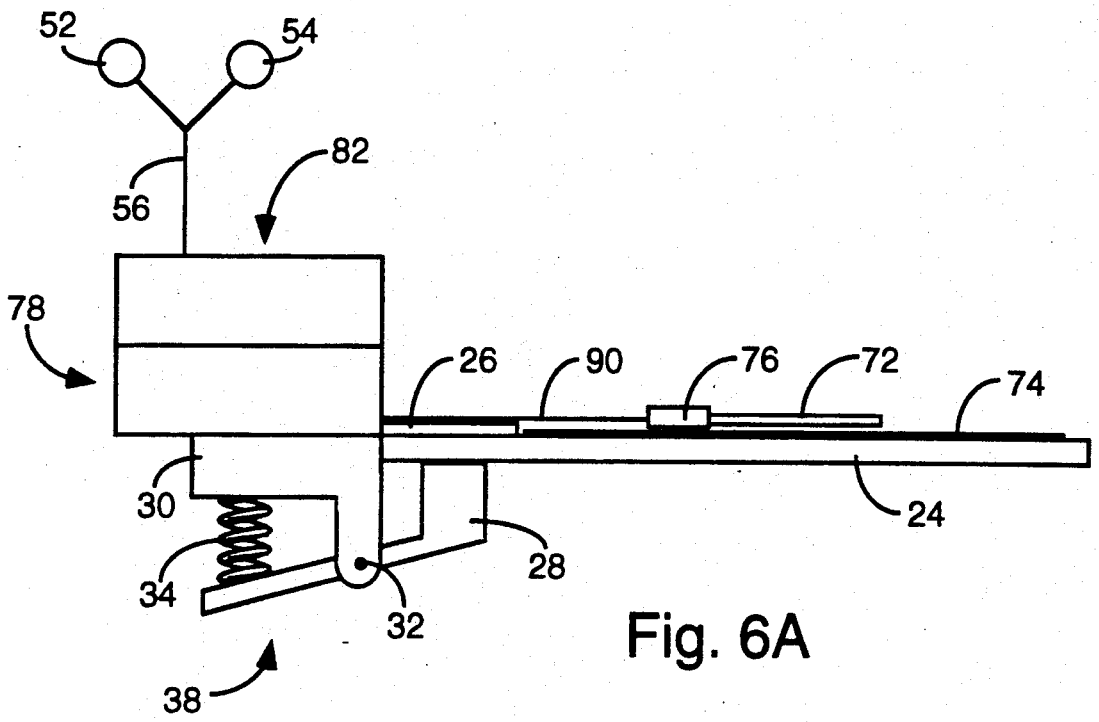
FIG. 6A is a cross sectional view taken along lines 6—6 in FIG. 4.
Figure 6B:
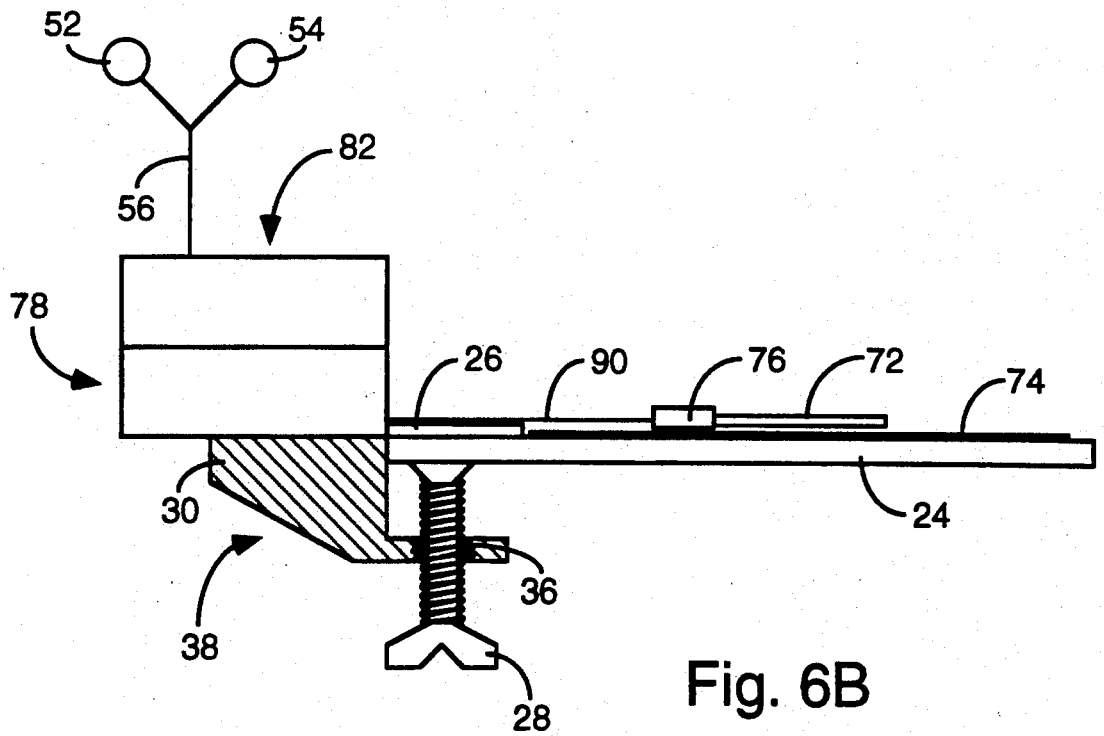
FIG. 6B is an alternate cross sectional view taken along lines 6—6 in FIG. 4.

An alternate embodiment of the attachable power-assisted copy indicator of the present invention is illustrated in FIG. 4 (perspective view), FIG. 5 (top view), FIG. 6A (side view), and FIG. 6B (alternate side view). A top mounted attachable power-assisted copy indicator assembly 78 is attached securely to a top edge 80 of planar surface 24 with mounting lip 26 and mounting clamp 28. In the embodiment shown in FIG. 6A, mounting clamp 28 is connected to mounting clamp arm 30 by pivot rod 32, with one end of pressure spring 34 connected to mounting clamp arm 30 and the other end of pressure spring 34 connected to mounting clamp 28. In the embodiment shown in FIG. 6B, mounting clamp 28 can be a thumbscrew or threaded bolt, and is connected to mounting clamp arm 30 by threaded screw guide 36. In both FIG. 6A and FIG. 6B, mounting clamp arm 30 is connected to copy indicator assembly 78 so that mounting clamp 28 opposes mounting lip 26. As needed, one or more mounting clamp assembly 38 will be connected to copy indicator assembly 78 to securely attach copy indicator assembly 78 to top edge 80 of planar surface 24.

As shown in FIG. 5, a top mounted attachable power-assisted copy indicator driving means assembly 82 includes driving means controller 44, drive motor 46, gear box 48, and coupling 50. The location of driving means assembly 82 is not limited to that shown in FIG. 4, FIG. 5, FIG. 6A, and FIG. 6B. It can be placed anywhere about copy indicator assembly 78 in order to provide its function. It is shown where it is to suggest one possible location. Drive motor 46 can be chosen from many different types of motors. Some of the possibilities are synchronous, stepping, constant speed, and variable speed; these motors may be run from some type of AC or DC power source, 42, as their specifications allow. Gear box 48 is only needed if the output of drive motor 46 requires stepping up or stepping down for actual use; if so, gear box 48 would be comprised of a gear ratio that when used with drive motor 46 would achieve an appropriate output rotation.

Driving means actuator one 52 and driving means actuator two 54 are connected to driving means controller 44 via actuator signal cables 56. Driving means actuator one 52 and driving means actuator two 54 can be embodied as keys attachable to a keyboard, floor pedals, push buttons, or any other type of actuating device that is convenient for the user to operate. Driving means controller 44 is to contain any intermediate electronics necessary for supplying power to the invention or transferring signals from driving means actuator one 52 and driving means actuator two 54 over to drive motor 46. Depending on the type of drive motor 46, driving means actuator one 52, and driving means actuator two 54 used, the design of driving means controller 44 may vary.

As shown in FIG. 5, a drive axle 84 is connected to the output of drive motor 46, or if used to the output of gear box 48, via coupling 50. Drive axle 84 spans the horizontal length of copy indicator assembly 78, and is held in position by a drive axle socket 86 at each end. Mounted on drive axle 84 is one or more of a feed cable spool 88. One feed cable spool 88 mounted near each end of drive axle 84 would probably be used, and will be assumed in all further references. Wrapped around each feed cable spool 88 used would be a uniform length of an indicator feed cable 90. Indicator feed cable 90 will pass over mounting lip 26. One end of the leftmost indicator feed cable 90 is to be attached securely to the leftmost feed cable spool 88 so that relatively little slippage occurs between the two objects, while the other end of the leftmost indicator feed cable 90 is to be attached securely but non-permanently to the leftmost end of indicator 72. Accordingly, one end of the rightmost indicator feed cable 90 is to be attached securely to the rightmost feed cable spool 88 so that relatively little slippage occurs between the two objects, while the other end of the rightmost indicator feed cable 90 is to be attached securely but non-permanently to the rightmost end of indicator 72. The result would be indicator 72 being supported by two of indicator feed cable 90 in a scaffold-like manner; horizontally along the long edge of indicator 72, as shown in FIG. 5. In saying indicator feed cable 90 is to be attached securely but non-permanently to the end of indicator 72, it is to be understood that the end of indicator feed cable 90 that is not attached to feed cable spool 88 is to be attached to indicator clamp 76. Indicator clamp 76 could be a holder or vice, for example, that can be opened and closed. Indicator feed cable 90 would be of sufficient length so that when fully reeled out from feed cable spool 88, indicator 72 would reach the bottom of copy 74 and/or planar surface 24. Indicator feed cable 90 could be neutral in color, completely transparent, or semi-transparent; one of these options should probably be used so that interference with copy 74 by indicator feed cable 90 is kept to a minimum. Copy 74 is the material that is to be scanned by the user, and is to be placed between indicator 72 and planar surface 24.

As the indicator feed cable 90 is non-permanently attached to indicator 72, indicator 72 can be removed, replaced, or exchanged with a different indicator 72. Indicator 72 can be made from a variety of materials like plastic, metal, or wood for example. The design of indicator 72 can vary as the application for which it will be used dictates. For instance, indicator 72 can be made of transparent plastic with guide lines or sections of different color running horizontally across it, parallel with lines of text that it may be overlaying. It can be opaque, only allowing the user to use the top or bottom edge of indicator 72 as a point of reference. Once again, the design of indicator 72 is completely flexible so as to provide the best solution for its chosen application.

Figure 7:
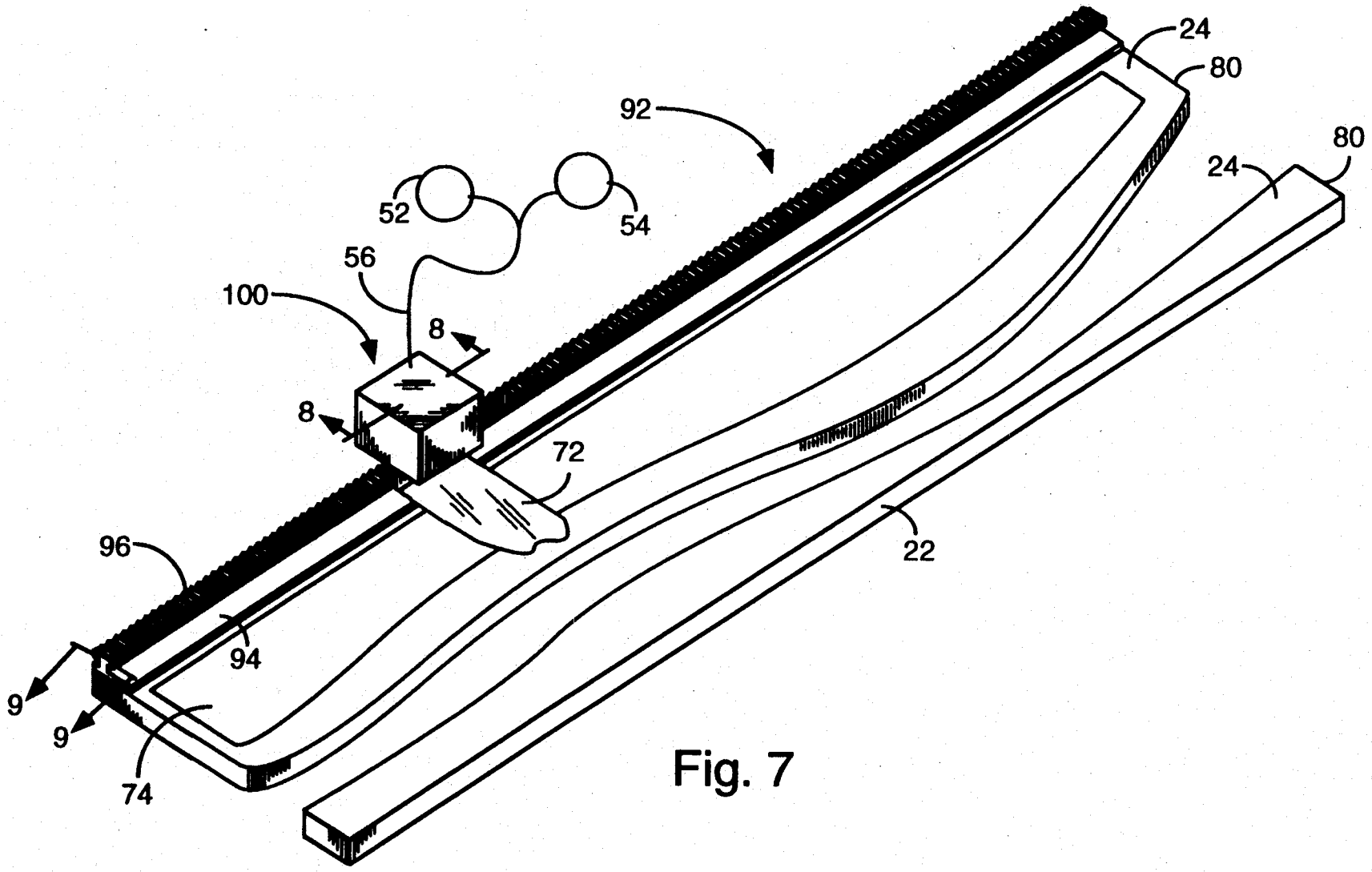
FIG. 7 is a perspective view of another alternate embodiment of an attachable power-assisted copy indicator.
Figure 8:
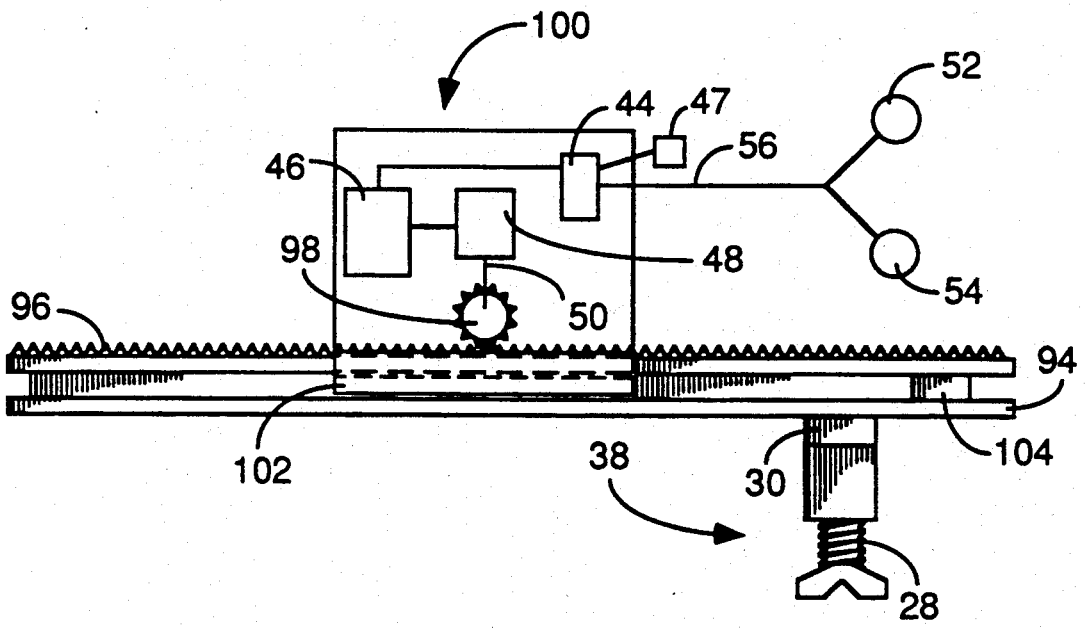
FIG. 8 is a cross sectional view taken along lines 8—8 in FIG. 7.
Figure 9A:
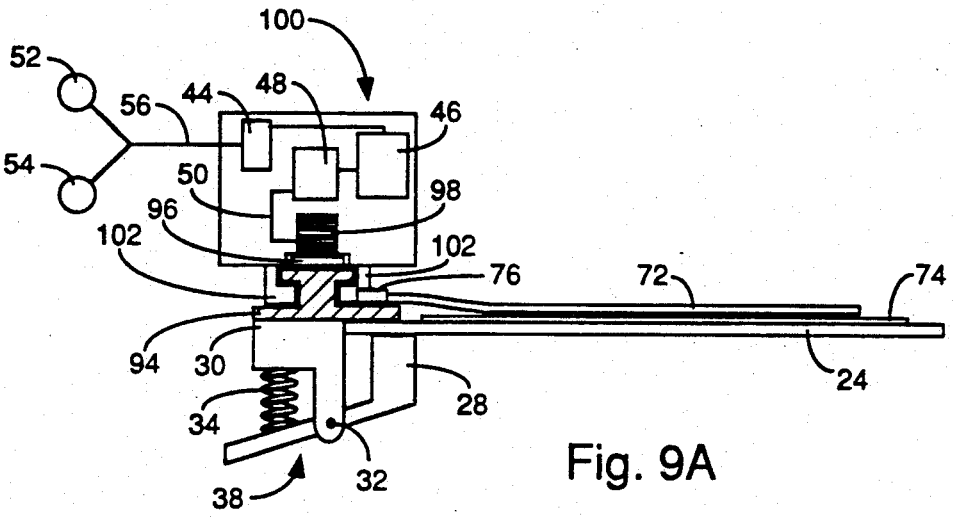
FIG. 9A is a cross sectional view taken along lines 9—9 in FIG. 7.
Figure 9B:
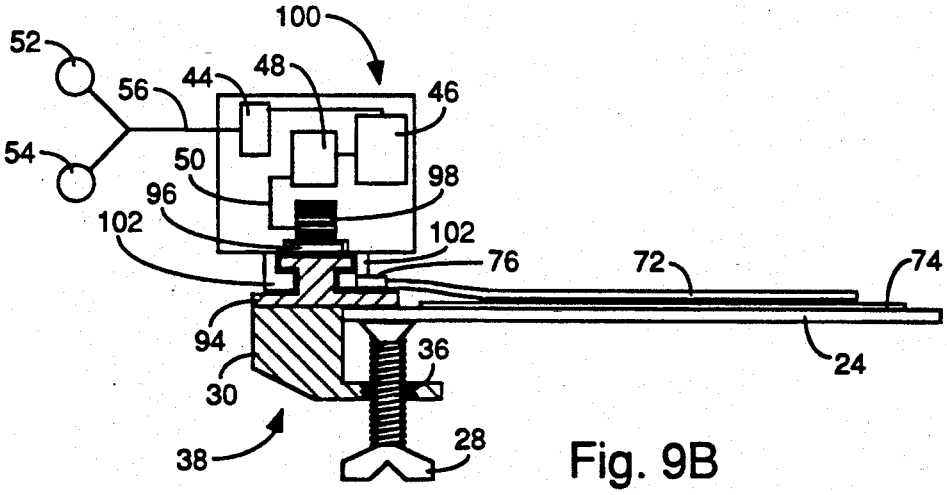
FIG. 9B is an alternate cross sectional view taken along lines 9—9 in FIG. 7.

Another alternate embodiment of the attachable power-assisted copy indicator of the present invention is illustrated in FIG. 7 (perspective view), FIG. 8 (side view), FIG. 9A (front view), and FIG. 9B (alternate front view). A compact side mounted attachable power-assisted copy indicator assembly 92 is attached securely to side edge 22 of planar surface 24 with a guide track 94 and mounting clamp 28. In the embodiment shown in FIG. 9A, mounting clamp 28 is connected to mounting clamp arm 30 by pivot rod 32, with one end of pressure spring 34 connected to mounting clamp arm 30 and the other end of pressure spring 34 connected to mounting clamp 28. In the embodiment shown in FIG. 9B, mounting clamp 28 can be a thumbscrew or threaded bolt, and is connected to mounting clamp arm 30 by threaded screw guide 36. In both FIG. 9A and FIG. 9B, mounting clamp arm 30 is connected to copy indicator assembly 92 so that mounting clamp 28 opposes the extended lower lip of guide track 94. As needed, one or more mounting clamp assembly 38 will be connected to copy indicator assembly 92 to securely attach copy indicator assembly 92 to the side edge of planar surface 24.

Attached to the top edge of guide track 94 is a traction surface 96, shown best in FIG. 8. Traction surface 96 is designed to provide a non-slip surface against which a traction wheel 98 can press. Traction surface 96 could be a toothed track as shown in FIG. 7, FIG. 8, FIG. 9A, and FIG. 9B, a rubber strip, or a surface like sand paper, for example. Accordingly, the design of traction wheel 98 is dependent on the design of traction surface 96. For instance, if traction surface 96 is to be a toothed track, traction wheel 98 would probably be a geared wheel. Similar design considerations are made if traction surface 96 is constructed differently than the previous examples. This interrelationship is shown best in FIG. 8.

As shown in FIG. 8, FIG. 91, and FIG. 9B, a compact side mounted attachable power-assisted copy indicator driving means assembly 100 includes driving means controller 44, drive motor 46, gear box 48, and coupling 50. Drive motor 46 can be chosen from many different types of motors. Some of the possibilities are synchronous, stepping, constant speed, and variable speed; these motors may be run from some type of AC or DC power source, 47, as their specifications allow. Gear box 48 is only needed if the output of drive motor 46 requires stepping up or stepping down for actual use; if so, gear box 48 would be comprised of a gear ratio that when used with drive motor 46 would achieve an appropriate output rotation.

Driving means actuator one 52 and driving means actuator two 54 are connected to driving means controller 44 via actuator signal cables 56. Driving means actuator one 52 and driving means actuator two 54 can be embodied as keys attachable to a keyboard, floor pedals, push buttons, or any other type of actuating device that is convenient for the user to operate. Driving means controller 44 is to contain any intermediate electronics necessary for supplying power to the invention or transferring signals from driving means actuator one 52 and driving means actuator two 54 over to drive motor 46. Depending on the type of drive motor 46, driving means actuator one 52, and driving means actuator two 54 used, the design of driving means controller 44 may vary.

Traction wheel 98 is connected to the output of drive motor 46, or if used to the output of gear box 48, via coupling 50. Traction wheel 98 should press firmly against traction surface 96, a result of a guide arm 102. This can be observed best in FIG. 9A and FIG. 9B. The top of guide track 94 will have a lip that extends out on both sides, such that a basic front view cross-section of guide track 94 would resemble a capital letter "T" or a capital letter "I". As such, guide arm 102 is designed in an "L" shape, and is attached to each side of the bottom of driving means assembly 100. The bottom lip of each guide arm 102 will hook beneath the extended lower lip of guide track 94, holding driving means assembly 100 in place atop guide track 94. This is shown best in FIG. 9A and FIG. 9B. A driving means assembly movement inhibitor 104 is mounted at each end of guide track 94, so as to prevent driving means assembly 100 from passing beyond the extreme ends of guide track 94. Driving means assembly movement inhibitor 104 is a physical block that could be molded as part of guide track 94, shown in FIG. 8.

Attached to guide arm 102 closest to copy 74 is indicator clamp 76, as shown in FIG. 9A and FIG. 9B. Indicator clamp 76 is a non-permanent clamping device, such as a holder or vice for example, that will securely hold indicator 72 in place. Indicator 72 is then attached in an orientation perpendicular to the length of guide track 94. Indicator 72 will extend out, over the extended lower lip of guide track 94 and copy 74, both of which are on top of planar surface 24. This is shown best in FIG. 7. Copy 74 is the material that is to be scanned by the user.

As indicator clamp 76 is to be openable and closable, indicator 72 can be removed, replaced, or exchanged with a different indicator 72. Indicator 72 can be made from a variety of materials like plastic, metal, or wood for example. The design of indicator 72 can vary as the application for which it will be used dictates. For instance, indicator 72 can be made of transparent plastic with guide lines or sections of different color running horizontally across it, parallel with lines of text that it may be overlaying. It can be opaque, only allowing the user to use the top or bottom edge of indicator 72 as a point of reference. Once again, the design of indicator 72 is completely flexible so as to provide the best solution for its chosen application.

OPERATION OF THE INVENTION

The operation of the preferred embodiment of the attachable power-assisted copy indicator of the present invention, illustrated in FIG. 1 (perspective view), FIG. 2 (top view), FIG. 3A (side view), FIG. 3B (alternate side view), and FIG. 10 (block diagram), will now be discussed. Using mounting clamp assembly 38, one first attaches side mounted attachable power-assisted copy indicator assembly 20 to an already existing planar surface 24. To do this, first each mounting clamp assembly 38 used should be opened. If using the embodiment shown in FIG. 3A, mounting clamp assembly 38 is opened by pressing down on mounting clamp 28 above where it is connected to pressure spring 34, compressing pressure spring 34, and causing mounting clamp 28 to pivot on pivot rod 32. This is done until a gap, wide enough for planar surface 24 to pass between mounting lip 26 and the portion of mounting clamp 28 that opposes mounting lip 26, is created. If using the embodiment shown in FIG. 3B, mounting clamp assembly 38 is opened by unscrewing mounting clamp 28 back through threaded screw guide 36 until a gap, wide enough to allow planar surface 24 to pass between mounting lip 26 and the portion of mounting clamp 28 that opposes mounting lip 26, is created. One should next butt copy indicator assembly 20 up against either the right or left hand edge of planar surface 24, so that when installed, indicator 72 will lay across planar surface 24. Mounting lip 26 should rest on top of the outwardly facing surface of planar surface 24, while the portion of mounting clamp 28 that opposes mounting lip 26 should pass beneath the underside of planar surface 24. Now, with copy indicator assembly 20 in this position, each mounting clamp assembly 38 used should be closed. If using the embodiment shown in FIG. 3A, mounting clamp assembly 38 is closed by releasing the pressure placed on mounting clamp 28 above where it is connected to pressure spring 34, allowing pressure spring 34 to expand, causing mounting clamp 28 to pivot on pivot rod 32. The portion of mounting clamp 28 that opposes mounting lip 26 will now exert pressure against the underside of planar surface 24. This results in planar surface 24 being clamped firmly between mounting lip 26 and the portion of mounting clamp 28 that opposes mounting lip 26. If using the embodiment shown in FIG. 3B, mounting clamp assembly 38 is closed by screwing mounting clamp 28 down through threaded screw guide 36. This is done until the portion of mounting clamp 28 that opposes mounting lip 26 firmly presses against the underside of planar surface 24. Once again, this results in planar surface 24 being clamped firmly between mounting lip 26 and the portion of mounting clamp 28 that opposes mounting lip 26.

One should then choose indicator 72 that is of appropriate design for the intended scanning application. The criteria that may be used for this choice could be the width of copy 74 to be scanned, the layout of copy 74 to be scanned, or the text size of copy 74 to be scanned, for example. The chosen indicator 72 would then be connected to indicator slide 64 by securely clamping it in place with indicator clamp 76. In its clamped position, the long edge of indicator 72 should extend horizontally across planar surface 24, shown best in FIG. 1. If desired, copy 74 should then be placed normally on planar surface 24, possible also covering all or a portion of mounting lip 26. Copy 74 should be placed beneath indicator 72.

At this point, copy indicator assembly 20 is ready for use. To do so, one decides which direction, either up or down, that indicator 72 should be moved. Accordingly, a driving means actuator will correspond to either upwards or downwards movement of indicator 72. From this point on it will be assumed that driving means actuator one 52 corresponds to upward movement of indicator 72, and that driving means actuator two 54 corresponds to downward movement of indicator 72. Once the desired direction of movement for indicator 72 is decided, to move indicator 72 in that direction, the appropriate driving means actuator should be activated. For example, if it is decided that indicator 72 should be moved in an upward direction, driving means actuator one 52 should be activated, causing indicator 72 to move upward along its vertical axis. Once indicator 72 reaches its desired new location, drving means actuator one 52 should be deactivated, causing indicator 72 to be at rest at its new location. If it is decided that indicator 72 should be moved in a downward direction, driving means actuator two 54 should be activated, causing indicator 72 to move downward along its vertical axis. Once indicator 72 reaches its desired new location, driving means actuator two 54 should be deactivated, causing indicator 72 to be at rest at its new location. It should be noted that if neither driving means actuator one 52 or driving means actuator two 54 are activated, indicator 72 should remain at rest at its current location.

The detailed electromechanical operation of copy indicator assembly 20 will now be explained.

When one activates driving means actuator one 52 or driving means actuator two 54, an electrical signal will propagate through actuator signal cables 56, and on to driving means controller 44. Depending on whether it was driving means actuator one 52 or driving means actuator two 54 that was activated, driving means controller 44 will then relay appropriate signals to drive motor 46, with the purpose of controlling drive motor 46. As the specifics of a motor controller are not within the scope of this invention, the detailed design of driving means controller 44 will not be discussed in this text. It will be assumed that driving means controller 44 will have the capability to receive power from an external source, supply appropriate operating power to drive motor 46, and supply appropriate control signals to drive motor 46 as directed by driving means actuator one 52 and driving means actuator two 54.

When drive motor 46 receives power and/or control signals from driving means controller 44, it will respond by rotating its output drive shaft in a clockwise or counter-clockwise direction. The determination of whether the output drive shaft of drive motor 46 is rotating in a clockwise or counter-clockwise direction is found by the reference point by which it is viewed. As discussed previously, if necessary, this output will serve as input to gear box 48. Whether gear box 48 is necessary or not, the final rotational output of drive motor 46 as realized by coupling 50, will be transferred to indicator drive belt 58 by pulley 60. Because coupling 50 is attached to pulley 60, and indicator drive belt 58 is fed around pulley 60 so as to be engaged by it, when coupling 50 rotates, indicator drive belt 58 is thus displaced in a clockwise or counter-clockwise direction as discussed previously. Indicator drive belt 58 then feeds around the configuration of drive belt router 62 used. As indicator drive belt 58 is displaced in a clockwise or counter-clockwise direction, it will accordingly displace indicator slide 64, and with it indicator 72, along the straight path dictated by indicator movement guide 68. Indicator slide 64 will not be able to pass beyond the extreme ends of the span of indicator drive belt 58 described previously, as the indicator movement inhibitor 70 placed at each of those extreme ends would prevent it from doing so. When indicator slide 64 reaches one of these physical blocks, further movement in that direction is thus restricted. In that way, the range of movement for indicator 72 is roughly from one end of the span of indicator drive belt 58 described previously to the other. If one desires, indicator slide 64 can be displaced manually (without activating driving means actuator one 52 or driving means actuator two 54) along the span of indicator drive belt 58 described previously. As shown in FIG. 2, with indicator slide 64 attached firmly but not permanently to indicator drive belt 58 by leaf spring 66 or similar device, this manually displacement becomes possible.

The operation of an alternate embodiment of the attachable power-assisted copy indicator of the present invention, illustrated in FIG. 4 (perspective view), FIG. 5 (top view), FIG. 6A (side view), and FIG. 6B (alternate side view), will now be discussed. Using mounting clamp assembly 38, one first attaches top mounted attachable power-assisted copy indicator assembly 78 to an already existing planar surface 24. To do this, first each mounting clamp assembly 38 used should be opened. If using the embodiment shown in FIG. 6A, mounting clamp assembly 38 is opened by pressing down on mounting clamp 28 above where it is connected to pressure spring 34, compressing pressure spring 34, and causing mounting clamp 28 to pivot on pivot rod 32. This is done until a gap, wide enough for planar surface 24 to pass between mounting lip 26 and the portion of mounting clamp 28 that opposes mounting lip 26, is created. If using the embodiment shown in FIG. 6B, mounting clamp assembly 38 is opened by unscrewing mounting clamp 28 back through threaded screw guide 36 until a gap, wide enough to allow planar surface 24 to pass between mounting lip 26 and the portion of mounting clamp 28 that opposes mounting lip 26, is created. One should next butt copy indicator assembly 78 up against the top edge of planar surface 24, so that when installed, indicator 72 will rest on top of the outwardly facing surface of planar surface 24. Mounting lip 26 should rest on top of the outwardly facing surface of planar surface 24, while the portion of mounting clamp 28 that opposes mounting lip 26 should pass beneath the underside of planar surface 24. Now, with copy indicator assembly 78 in this position, each mounting clamp assembly 38 used should be closed. If using the embodiment shown in FIG. 6A, mounting clamp assembly 38 is closed by releasing the pressure placed on mounting clamp 28 above where it is connected to pressure spring 34, allowing pressure spring 34 to expand, causing mounting clamp 28 to pivot on pivot rod 32. The portion of mounting clamp 28 that opposes mounting lip 26 will now exert pressure against the underside of planar surface 24. This results in planar surface 24 being clamped firmly between mounting lip 26 and the portion of mounting clamp 28 that opposes mounting lip 26. If using the embodiment shown in FIG. 6B, mounting clamp assembly 38 is closed by screwing mounting clamp 28 down through threaded screw guide 36. This is done until the portion of mounting clamp 28 that opposes mounting lip 26 firmly presses against the underside of planar surface 24. Once again, this results in planar surface 24 being clamped firmly between mounting lip 26 and the portion of mounting clamp 28 that opposes mounting lip 26.

One should then choose indicator 72 that is of appropriate design for the intended scanning application. The criteria that may be used for this choice could be the width of copy 74 to be scanned, the layout of copy 74 to be scanned, or the text size of copy 74 to be scanned, for example. The chosen indicator 72 would then be connected to indicator feed cable 90 by securely clamping it in place with indicator clamp 76. In its clamped position, the long edge of indicator 72 should extend horizontally across planar surface 24, shown best in FIG. 4. If desired, copy 74 should then be placed normally on planar surface 24, possibly also covering all or a portion of mounting lip 26. Copy 74 should be placed beneath indicator 72 and any indicator feed cable 90 used.

At this point, copy indicator assembly 78 is ready for use. To do so, one decides which direction, either up or down, that indicator 72 should be moved. Accordingly, a driving means actuator will correspond to either upwards or downwards movement of indicator 72. From this point on it will be assumed that driving means actuator one 52 corresponds to upward movement of indicator 72, and that driving means actuator two 54 corresponds to downward movement of indicator 72. Once the desired direction of movement for indicator 72 is decided, to move indicator 72 in that direction, the appropriate driving means actuator should be activated. For example, if it is decided that indicator 72 should be moved in an upward direction, driving means actuator one 52 should be activated, causing indicator 72 to move upward along its vertical axis. Once indicator 72 reaches its desired new location, driving means actuator one 52 should be deactivated, causing indicator 72 to be at rest at its new location. If it is decided that indicator 72 should be moved in a downward direction, driving means actuator two 54 should be activated, causing indicator 72 to move downward along its vertical axis. Once indicator 72 reaches its desired new location, driving means actuator two 54 should be deactivated, causing indicator 72 to be at rest at its new location. It should be noted that if neither driving means actuator one 52 or driving means actuator two 54 are activated, indicator 72 should remain at rest at its current location. The detailed electromechanical operation of copy indicator assembly 78 will now be explained.

When one activates driving means actuator one 52 or driving means actuator two 54, an electrical signal will propagate through actuator signal cables 56, and on to driving means controller 44. Depending on whether it was driving means actuator one 52 or driving means actuator two 54 that was activated, driving means controller 44 will then relay appropriate signals to drive motor 46, with the purpose of controlling drive motor 46. As the specifics of a motor controller are not within the scope of this invention, the detailed design of driving means controller 44 will not be discussed in this text. It will be assumed that driving means controller 44 will have the capability to receive power from an external source, supply appropriate operating power to drive motor 46, and supply appropriate control signals to drive motor 46 as directed by driving means actuator one 52 and driving means actuator two 54.

When drive motor 46 receives power and/or control signals from driving means controller 44, it will respond by rotating its output drive shaft in a clockwise or counter-clockwise direction. The determination of whether the output drive shaft of drive motor 46 is rotating in a clockwise or counter-clockwise direction is to be found by the reference point by which it is viewed. As discussed previously, if necessary, this output will serve as input to gear box 48. Whether gear box 48 is necessary or not, the final rotational output of drive motor 46 as realized by coupling 50, will be transferred to drive axle 84. Thus when coupling 50 rotates, so does drive axle 84 and each feed cable spool 88 attached to it, all in the same clockwise or counter-clockwise direction as coupling 50. As drive axle 84 is held in place by drive axle socket 86 at each end, the motion of drive axle 84 is limited to rotational motion about its horizontal center axis.

It is known by previous discussion that indicator feed cable 90 is connected to each feed cable spool 88 used. Therefore, when the rotation of drive axle 84 causes each feed cable spool 88 to rotate as well, the uniform lengths of indicator feed cable 90 are reeled in around feed cable spool 88, or reeled out from feed cable spool 88. Whether the uniform lengths of indicator feed cable 90 are reeled in or reeled out depends on the direction of rotation of drive axle 84. With this in mind, it follows that if the uniform lengths of indicator feed cable 90 are actively being reeled in, indicator 72 will rise up the outwardly facing surface of planar surface 24. Likewise, if the uniform lengths of indicator feed cable 90 are actively being reeled out, indicator 72 will descend the outwardly facing surface of planar surface 24. As each indicator feed cable 90 is of uniform length, the horizontal alignment of indicator 72 along its long edge should be maintained.

The operation of another alternate embodiment of the attachable power-assisted copy indicator of the present invention, illustrated in FIG. 7 (perspective view), FIG. 8 (side view), FIG. 9A (front view), and FIG. 9B (alternate front view), will now be discussed. Using mounting clamp assembly 38, one first attaches compact side mounted attachable power-assisted copy indicator assembly 92 to an already existing planar surface 24. To do this, first each mounting clamp assembly 38 used should be opened. If using the embodiment shown in FIG. 9A, mounting clamp assembly 38 is opened by pressing down on mounting clamp 28 above where it is connected to pressure spring 34, compressing pressure spring 34, and causing mounting clamp 28 to pivot on pivot rod 32. This is done until a gap, wide enough for planar surface 24 to pass between the extended lower lip of guide track 94 and the portion of mounting clamp 28 that opposes extended lower lip of guide track 94, is created. If using the embodiment shown in FIG. 9B, mounting clamp assembly 38 is opened by unscrewing mounting clamp 28 back through threaded screw guide 36 until a gap, wide enough for planar surface 24 to pass between the extended lower lip of guide track 94 and the portion of mounting clamp 28 that opposes the extended lower lip of guide track 94, is created. One should next butt copy indicator assembly 92 up against either the right or left hand edge of planar surface 24, so that when installed, indicator 72 will lay across planar surface 24. Mounting lip 26 should rest on top of the outwardly facing surface of planar surface 24, while the portion of mounting clamp 28 that opposes the extended lower lip of guide track 94 should pass beneath the underside of planar surface 24. Now, with copy indicator assembly 92 in this position, each mounting clamp assembly 38 used should be closed. If using the embodiment shown in FIG. 9A, mounting clamp assembly 38 is closed by releasing the pressure placed on mounting clamp 28 above where it is connected to pressure spring 34, allowing pressure spring 34 to expand, causing mounting clamp 28 to pivot on pivot rod 32. The portion of mounting clamp 28 that opposes the extended lower lip of guide track 94 will now exert pressure against the underside of planar surface 24. This results in planar surface 24 being clamped firmly between the extended lower lip of guide track 94 and the portion of mounting clamp 28 that opposes the extended lower lip of guide track 94. If using the embodiment shown in FIG. 9B, mounting clamp assembly 38 is closed by screwing mounting clamp 28 down through threaded screw guide 36. This is done until the portion of mounting clamp 28 that opposes the extended lower lip of guide track 94 firmly presses against the underside of planar surface 24. Once again, this results in planar surface 24 being clamped firmly between the extended lower lip of guide track 94 and the portion of mounting clamp 28 that opposes the extended lower lip of guide track 94.

One should then choose indicator 72 that is of appropriate design for the intended scanning application. The criteria that may be used for this choice could be the width of copy 74 to be scanned, the layout of copy 74 to be scanned, or the text size of copy 74 to be scanned, for example. The chosen indicator 72 would then be connected to driving means assembly 100 by securely clamping it is place with indicator clamp 76. In its clamped position, the long edge of indicator 72 should extend horizontally across planar surface 24, shown best in FIG. 7. If desired, copy 74 should then be placed normally on planar surface 24, possibly also covering all or a portion of the extended lower lip of guide track 94. Copy 74 should be placed beneath indicator 72.

At this point, copy indicator assembly 92 is ready for use. To do so, one decides which direction, either up or down, that indicator 72 should be moved. Accordingly, a driving means actuator will correspond to either upwards or downwards movement of indicator 72. From this point on it will be assumed that driving means actuator one 52 corresponds to upward movement of indicator 72, and that driving means actuator two 54 corresponds to downward movement of indicator 72. Once the desired direction of movement for indicator 72 is decided, to move indicator 72 in that direction, the appropriate driving means actuator should be activated. For example, if it is decided that indicator 72 should be moved in an upward direction, driving means actuator one 52 should be activated, causing indicator 72 to move upward along its vertical axis. Once indicator 72 reaches its desired new location, driving means actuator one 52 should be deactivated, causing indicator 72 to be at rest at its new location. If it is decided that indicator 72 should be moved in a downward direction, driving means actuator two 54 should be activated, causing indicator 72 to move downward along its vertical axis. Once indicator 72 reaches its desired new location, driving means actuator two 54 should be deactivated, causing indicator 72 to be at rest at its new location. It should be noted that if neither driving means actuator one 52 or driving means actuator two 54 are activated, indicator 72 should remain at rest at its current location. The detailed electromechanical operation of copy indicator assembly 92 will now be explained.

When one activates driving means actuator one 52 or driving means actuator two 54, an electrical signal will propagate through actuator signal cables 56, and on to driving means controller 44. Depending on whether it was driving means actuator one 52 or driving means actuator two 54 that was activated, driving means controller 44 will then relay appropriate signals to drive motor 46, with the purpose of controlling drive motor 46. As the specifics of a motor controller are not within the scope of this invention, the detailed design of driving means controller 44 will not be discussed in this text. It will be assumed that driving means controller 44 will have the capability to receive power from an external source, supply appropriate operating power to drive motor 46, and supply appropriate control signals to drive motor 46 as directed by driving means actuator one 52 and driving means actuator two 54.

When drive motor 46 receives power and/or control signals from driving means controller 44, it will respond by rotating its output drive shaft in a clockwise or counter-clockwise direction. The determination of whether the output drive shaft of drive motor 46 is rotating in a clockwise or counter-clockwise direction is to be found by the reference point by which it is viewed. As discussed previously, if necessary, this output will serve as input to gear box 48. Whether gear box 48 is necessary or not, the final rotational output of drive motor 46 as realized by coupling 50, will be transferred to traction wheel 98. Thus when coupling 50 rotates, traction wheel 98 rotates in the same clockwise or counter-clockwise direction. As discussed previously, traction wheel 98 should press firmly against traction surface 96.

Also discussed previously was that the bottom lip of each guide arm 102 used should hook beneath the extended lower lip of guide track 94. With these two ideas in mind, when traction wheel 98 rotates in a clockwise or counter-clockwise direction, traction wheel 98 engages traction surface 96, causing traction wheel 98 to move backwards or forwards along guide track 94. As traction wheel 98 is mounted within driving means assembly 100, when traction wheel 98 moves backwards or forwards along guide track 94, so will driving means assembly 100. Driving means assembly 100 will not be able to pass beyond the extreme ends of guide track 94, as the driving means assembly movement inhibitor 104 placed at each of those extreme ends would prevent it from doing so. When driving means assembly 100 reaches one of these physical blocks, further movement in that direction is thus restricted. As indicator 72 is connected to driving means assembly 100 by indicator clamp 76, and thus moves as driving means assembly 100 moves, the range of movement for indicator 72 is roughly from one end of guide track 94 to the other.

SUMMARY, RAMIFICATIONS, AND SCOPE

Thus it can be seen that the attachable power-assisted copy indicator of the present invention provides a reliable, simply designed, and economical way to allow users to upgrade their current copyholders or similar planar surfaces to have power-assisted copy indicators. By merely fastening the attachable power-assisted copy indicator of the invention to an already existing planar surface, the user can acquire power-assisted copy indicator capabilities that were previously expensive and difficult to obtain. In this way, existing equipment can be maximally utilized, costing the user less to enjoy the fatigue relieving benefits of a power-assisted copy indicator. Furthermore, the attachable power-assisted copy indicator of the invention has the additional advantages in that:

it is easily attached to virtually any copy stand or similar planar surface, providing that surface with a power-assisted copy indicator;

it allows the user to choose a copy indicator that is designed suitably for the chosen scanning application, utilizing ergonomics to make obsolete the complex mechanics and electronics used by devices with line sensing and spacing mechanisms;

it represents a simple concept that extends to its simple design and many possible design variations, allowing construction from relatively few parts, many of which should be readily available;

it allows simple design possibilities that result in fewer mechanical and electronic breakdowns, and inexpensive repair if breakdowns occur.

Although the previous description contains many specificities, these should not be construed as limitations on the scope of the invention, but rather as exemplifications of some of the presently preferred embodiments thereof. Countless other variations are possible. For example, line sensing and spacing mechanisms could be used if desired; the driving means actuators could be pressure sensing, allowing the user to signal driving means controller 44 to vary the copy indicator speed; the parts layout of the invention could be rearranged for greater compactness; the mechanical parts of the device could be built from a variety of materials like plastic, wood, or metal, for instance; different clamping devices could be used for attaching the invention to planar surface 24, etc.

Accordingly, the scope of the invention should be determined not by the embodiments illustrated, but by the appended claims and their legal equivalents.

We claim:

1. A power assisted copy indicator attachable to a planar surface at an edge thereof, comprising:

(a) an indicator, (b) a drive motor and gear box assembly that effects displacement of said indicator, (c) a pressure mounting clamp assembly connected to said drive motor and gear box assembly that is openable and closeable to removably attach said drive motor and gear box assembly to the edge of the planar surface when engaged, (d) a vice-like indicator clamp that is openable and closeable to removably attach said indicator to said drive motor and gear box assembly when engaged, (e) a driving means actuator one connected to said drive motor and gear box assembly that is activatable and deactivatable to signal said drive motor and gear box assembly to displace said indicator in one direction relative to said planar surface, (f) a driving means actuator two connected to said drive motor and gear box assembly that is activatable and deactivatable to signal said drive motor and gear box assembly to displace said indicator in a direction opposite to that signaled by said driving means actuator one.

2. The attachable power assisted copy indicator of claim 1 wherein said indicator extends horizontally up to the full width of said planar surface, and wherein said indicator is mounted for movement vertically across the full length of said planar surface and an indicator movement inhibitor connected to said drive motor and gear box assembly at the extremities of the length of said planar surface blocks movement of said indicator beyond the extremities of said planar surface.

3. The attachable power assisted copy indicator of claim 1 wherein said drive motor and gear box assembly comprises a driving means controller, a drive motor, a coupling, and a gear box that transfers energy from said drive motor to said indicator.

4. The attachable power assisted copy indicator of claim 3, further including a power source that supplies energy to the drive motor.

5. The attachable power assisted copy indicator of claim 1 wherein said pressure mounting clamp assembly is connected to said drive motor and gear box assembly to allow said drive motor and gear box assembly to be removably attached to the edge of said planar surface.

6. The attachable power assisted copy indicator of claim 1 wherein said pressure mounting clamp assembly includes a clamp that engages and disengages said planar surface between said clamp and a lip connected to said drive motor and gear box assembly.

7. The attachable power assisted copy indicator of claim 1 wherein said vice-like indicator clamp holds said indicator transversely over said planar surface when engaged.

8. The attachable power assisted copy indicator of claim 1 wherein said vice-like indicator clamp includes an openable and closeable clamp that engages and disengages said indicator so the indicator can be removed, replaced or exchanged.

9. The attachable power assisted copy indicator of claim 1 wherein said driving means actuator one includes at least one activatable and deactivatable operator convenient actuating device that activates and deactivates said drive motor and goal box assembly to effect movement of said indicator in one direction relative to said planar surface, and wherein said driving means actuator two includes at least one activatable and deactivatable operator convenient actuating device that activates and deactivates said drive motor and gear box assembly to effect movement of said indicator in a direction opposite to that effected by said driving means actuator one.

10. An attachable power assisted copy indicator that attaches easily to an edge of a copyholder having a planar surface for holding a copy, comprising:

(a) an indicator, (b) an indicator driving means assembly that effects displacement of said indicator over the planar surface and the copy held thereby, (c) a pressure mounting clamp assembly connected to said indicator driving means assembly that is openable and closeable to removably attach said indicator driving means assembly to the edge of the planar surface when engaged, (d) a driving means controller connected to said indicator driving means assembly that is activatable and deactivatable to signal said indicator driving means assembly to displace said indicator over said planar surface and the copy held thereby

11. The attachable power assisted copy indicator of claim 11 wherein said indicator extends horizontally up to the full width of said planar surface, and wherein said indicator is movable vertically over the full length of said planar surface, and wherein said indicator extends transversely over said planar surface.

12. The attachable power assisted copy indicator of claim 10 wherein said pressure mounting clamp assembly is openable and closeable and is connected to said indicator driving means assembly to allow said indicator driving means assembly to be removably secured and attached to said planar surface by said pressure mounting clamp assembly firmly pressing said planar surface against a lip connected to said indicator driving means assembly when said pressure mounting clamp assembly is closed to be engaged.

13. The attachable power assisted copy indicator of claim 10 wherein said pressure mounting clamp assembly is closeable and openable to respectively engage and disengage said planar surface by pressing it against a lip on the indicator driving means assembly.

14. The attachable power assisted copy indicator of claim 10 wherein said indicator driving means assembly has a vice-like indicator clamp that is adjustable from a closed position engaged with said indicator to an open position disengaged from said indicator.

15. The attachable power assisted copy indicator of claim 10 wherein said indicator driving means assembly comprises a drive motor, a power source to said indicator driving means assembly, and a gear box to transfer energy from said drive motor to move said indicator.

16. The attachable power assisted copy indicator of claim 10 wherein said driving means controller has activatable and deactivatable indicator driving means actuators one and two that activate and deactivate said indicator driving means assembly to effect movement of said indicator over said planar surface and the copy held thereby.

17. A power assisted copy indicator attachable to a planar surface at an edge thereof; comprising:

an indicator, an indicator driving means assembly that effects displacement of said indicator, a pressure mounting clamp assembly that is openable and closeable to securely attach said indicator driving means assembly to the edge of the planar surface when engaged, at least one activatable and deactivatable driving means actuator connected to said indicator driving means assembly that signals said indicator driving means assembly to displace said indicator over said planar surface and the copy held thereby, said indicator movable vertically across the full length of said planar surface, said pressure mounting clamp assembly connected to said indicator driving means assembly to allow said indicator driving means assembly to be securely but removably attached to the edge of said planar surface, said pressure mounting clamp assembly is closeable and openable to respectively engage and disengage said planar surface by firmly pressing it against a lip on the indicator driving means assembly, said indicator driving means assembly has a vice-like indicator clamp that is openable and closeable and engages and disengages with said indicator, said indicator driving means assembly comprising a drive motor, a power source to said indicator driving means assembly, and a gearbox to transfer energy from said drive motor to move said indicator, said driving means actuator that activates and deactivates said indicator driving means assembly to effect movement of said indicator over said planar surface and the copy held thereby.

* * * * *